United States Patent [19]

Shaw et al.

[11] 3,989,165

[45] Nov. 2, 1976

[54] COMPARTMENT BAG FOR AEROSOL CONTAINER

[75] Inventors: Fred B. Shaw, Hinsdale; Clyde F. DuPuis, Downers Grove, both of Ill.

[73] Assignee: Continental Can Company, Inc., New York, N.Y.

[22] Filed: Nov. 14, 1974

[21] Appl. No.: 523,638

Related U.S. Application Data

[63] Continuation-in-part of Ser. No. 335,192, Feb. 23, 1973, abandoned, which is a continuation of Ser. No. 135,964, April 21, 1971, abandoned.

[52] U.S. Cl. ..... 222/23; 222/94; 222/193

[51] Int. Cl.[2] ..... B67D 5/54

[58] Field of Search ..... 222/94, 95, 193, 386.5, 222/23

[56] References Cited

UNITED STATES PATENTS 3,602,397 8/1971 Marand ..... 222/95

3,730,437 5/1973 Rousseloti ..... 222/94 X

*Primary Examiner*—Allen N. Knowles
*Assistant Examiner*—Hadd S. Lane
*Attorney, Agent, or Firm*—John J. Kowalik; Joseph E. Kerwin; William A. Dittmann

[57] ABSTRACT

An aerosol container having a propellant means and a flexible product bag enclosed within a flexible deformable plastic container such as polyethylene. The propellant causes the product in the bag to discharge which reduces the volume of the product in the enclosing container thus reducing the pressure of the gas within the container to subatmospheric pressure. This collapses the container and is an indication that the contents have been used.

10 Claims, 4 Drawing Figures

COMPARTMENT BAG FOR AEROSOL CONTAINER

BACKGROUND OF THE INVENTION

This application is a continuation-in-part of our U.S. application, Ser. No. 335,192, filed Feb. 23, 1973, which was a continuation of U.S. application Ser. No. 135,964, filed Apr. 21, 1971, both now abandoned.

The present invention relates to aerosol containers of the dispensing type and having a compartment for separating the product and the pressurized propellant in the container.

Aerosol dispenser containers are of a number of different types, all of which have the common characteristics of an exterior body, a dispensing valve, a compressed gas propellant, and a product which when expelled through the open particles small enough that they will remain suspended in the atmosphere for appreciable periods of time.

In the earliest aerosol dispensing packages the product and the compressed gas are both held in the body in a single chamber. This required the body to be impermeable to the gas and that all components of the product be inert and insoluble to all the body materials. Accordingly, such aerosol containers were primarily entirely metallic, although some heavy wall glass structures were also used.

One of the principal shortcomings of this initial type of aerosol dispenser was the fact that the propellant was required to be non-reactive with any component of the product at elevated temperature and over long periods of time. Another shortcoming was the fact that two component aerosols which could not tolerate mixing until the moment of discharge could not be accommodated.

Some of the above described deficiencies of the earliest aerosol dispensing packages were overcome by the pressurized type compartmentized container shown for example in U.S. Pat. No. 3,433,391 and the aspirating type container shown in U.S. Pat. No. 3,289,949.

In the pressurized type compartmentized can, product is packaged in a compressible semi-rigid contractable plastic inner compartment, while the propellant is contained in the outer metallic body in which the inner compartment is disposed. The composition of the plastic inner compartment can be selected to be chemically compatible with the product, but the outer metallic body need only be chemically compatible with the propellant. Further, there is relatively little permeation of the propellant gas into the product and essentially no permeation of the product into the container housing the propellant.

The container as described in U.S. Pat. No. 3,289,949 confines the propellant gas in a small metallic chamber and places the product in the body of the package. A dip tube extends from the valve body to the bottom of the exterior chamber of the container. When the valve of this package is opened, the escaping propellant, passing through a venturi, draws the liquid product through the dip tube to be discharged. Accordingly, it is only at the instant of discharge that the propellant and the product come in contact. Because of this design, true chemical compatibility between the propellant and the product is not required, and it is possible to package a reactive two-component product by placing one component in the propellant chamber. However, in this design, the exterior body does have to be impermeable to all components packaged therein and none of these components should be capable of attaching or dissolving any portion of the body.

These latter requirements would be relative undemanding where the outer body is frabricated from an inert metal or glass of sufficient thickness to resist deformation as the pressure drops in the body chamber as it becomes evacuated. But in order to make this container attractive, light weight and economical, a blow-molded plastic body has been used. The plastic structure requires that some type of a vent arrangement be provided to allow pressure adjustment within the outer chamber. However, such a vent allows the escape of highly volatile components of the product. Accordingly, the structure exemplified by the 3,289,949 Patent has had only limited application for use only with products that are compatible with the blow-molded bodies, and where the existence of a vent can be accommodated without adversely effecting the integrity of the product. Even in such cases the relatively high permeability of most blow-molded plastic containers to alcohol or moisture or both results in limited shelf life of products having such components.

This is accomplished by the provision of a flexible compartment bag which is disposed in the chamber usually provided for this purpose in the container body. The product compartment bag is connected to and communicates with the dispensing valve.

SUMMARY OF THE INVENTION

By the present invention, it is proposed to provide an improved container of the foregoing described aspirating type having structure which overcomes the difficulties encountered heretofore. The bag is made of a flexible sheet material such as film plastic or the like.

In the preferred form of the invention, the sheet material is formed with a roughen or knurl surface which is disposed in the interior of the bag to provide passage therein. The sheet material is preferably folded into a generally rectilinear shape and the free edges are joined as by heat sealing so as to form an enclosed compartment. A valve adapter is fixed to the bag adjacent the folded edge and close to one corner thereof. The valve adapter is attached to the dispensing valve mounted on the body so that upon actuation of the valve to an open position, the product is discharged therefrom.

The bottle which is made of thin deformable or flexible plastic is adapted to collapse inwardly as the product is withdrawn from the bag.

DESCRIPTION OF THE PREFERRED EMBODIMENT

Figure 1:
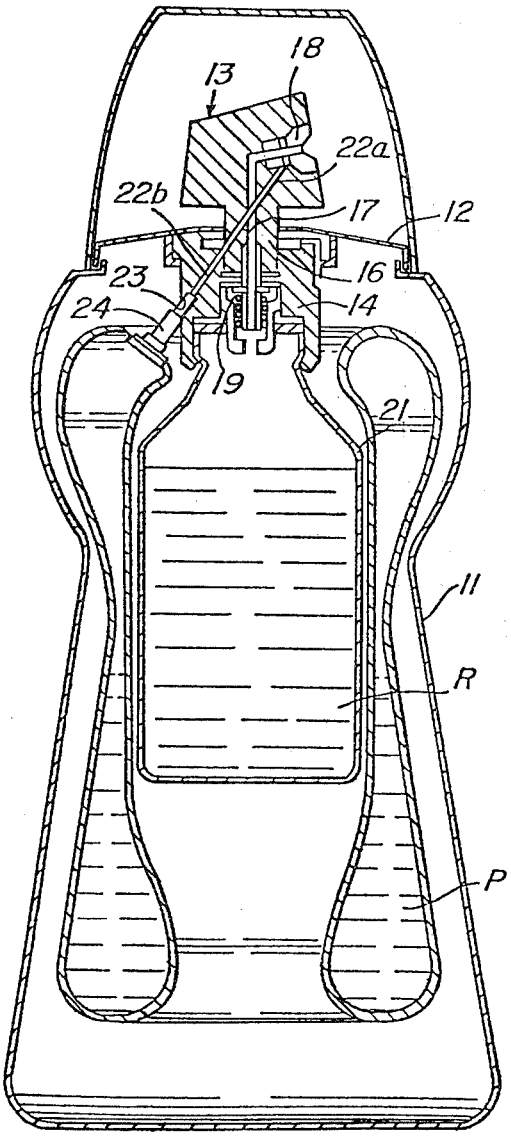
FIG. 1 is a cross sectional view of an aerosol container embodying the compartment bag of the present invention.
Figure 2:
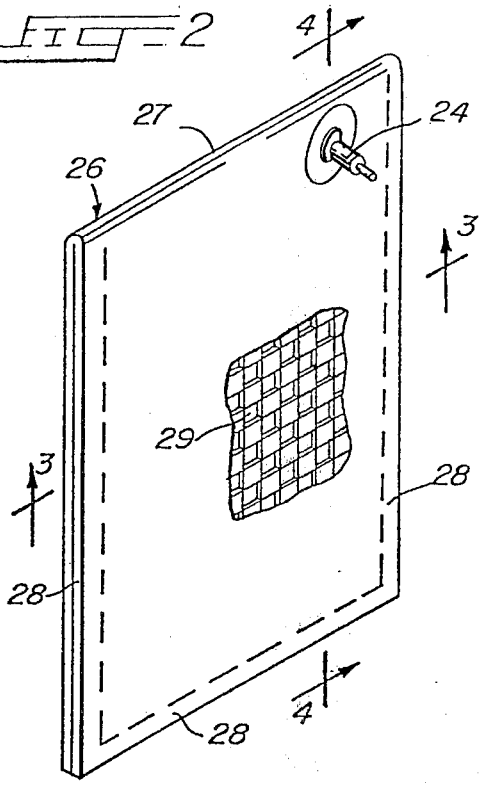
FIG. 2 is a perspective view of an empty compartment bag prior to being inserted into the container.
Figure 4:
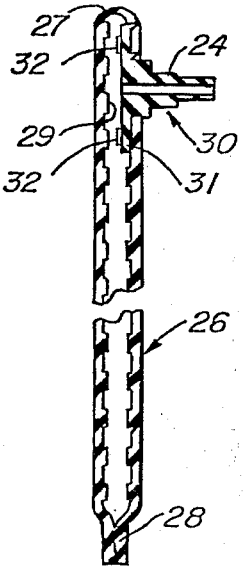
FIG. 4 is a cross sectional view taken generally along the lines 4—4 of FIG. 2.
Figure 3:
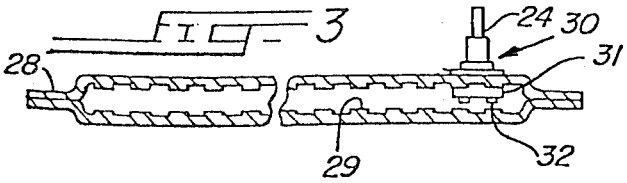
FIG. 3 is a fragmentary cross sectional view taken generally along the lines 3—3 of FIG. 2.

Referring now to the drawings, there is shown an aerosol container 10 of the type in which the product is maintained separate from the propellant in a manner shown in U.S. Pat. No. 3,289,949.

The container 10 comprises generally a body 11 which may be made from plastic and may be formed by blow-molding into a desired shape. A top collar 12 is fastened to the open upper end of the body 11 and supports a dispensing valve 13. The dispensing valve 13 may be of the type shown in U.S. Pat. No. 3,289,949 to which reference is made for a more complete description thereof.

The dispensing valve 13 comprises generally a valve body 14 attached to the underside of the top collar 12. Slidably disposed in the valve body 14 is an actuating valve stem 16. The actuating stem 16 has an outlet passage 17 terminating in a venturi discharge opening 18. The lower end of the valve stem 16 engages a substantially standard valve 19 which is opened upon depression of the actuating valve stem 16. Fixed to the underside of the valve body is a rigid cartridge 21 containing the propellant for discharging the product from the container. The propellant is under pressure and the rigid cartridge 21 is made of a rigid material such as metal or the like to withstand the pressure forces exerted thereon by the pressurized propellant.

Extending through the valve are product discharge passages 22*a* and 22*b* of which one length 22*a* is formed in the actuating valve stem 16 and the other length 22*b* is formed in the valve body 14.

The length 22*a* communicates with the constricted portion of the venturi discharge opening 18. The length of the passage 22*b* formed in the valve body 14 includes a terminal enlarged port 23 which is adapted to receive the inlet tube of a compartment bag 26.

In accordance with the present invention, the compartment bag 26 is formed from a flexible sheet material. In the embodiment shown, the sheet material is folded into a rectlinear or rectangular shaped compartment so that one edge 27 is folded. The remaining edges 28 are sealed as by a suitable adhesive or heat sealing. The sheet material may be a poly-plastic film such as polyethylene or the like and preferably is of the type which may be heat sealed to facilitate the sealing of or bonding of the edges. The particular type of material is dependent upon the product which is to be dispensed. In other words, it should be compatible and capable of retaining the product therein with a minimum of permeation. Under some circumstances, in order to retain or achieve low permeability characteristics it may be necessary to fabricate the compartment from a laminate of two or more polymer sheets, occasionally with cellulosic and/or metallic plies, if required. However, in all cases, the underply must be heat sealable and except for permeability should be insoluble in any component or product adapted to be packaged therein. The material should also be resistant to stress cracking in the presence of the product.

In the preferred form, the inner ply or the roughened inner face 29 of the compartment bag 26 is embossed or knurled so as to provide a roughen surface. A roughen surface 29 provides passages for the product when the bag tends to collapse under the pressure force acting thereon the bag. The bag thus is always provided with passages to a valve adapter 30 to assure that the product will be discharged.

The valve adapter 30 as shown, includes an annular base 31 or which is bonded as by heat sealing to the inner surface or face of the compartment bag 26. A plurality of radially extending and annular spaced lugs 32 or embossments are provided on the underside of the annular base 31. The lugs or embossments serve to maintain the overlying inner roughened faces 29 spaced at the inlet end of the inlet tube 24 of the valve adapter 30. The inlet tube 24 is formed integral with the annular base 31 and has an internal diameter adquate to permit the filling thereof with product.

As described heretofore, in prior containers of the foregoing type is has been necessary to vent the container body to maintain an equalization of pressure in the body to prevent collapse thereof. With the present structure of a compartment bag within the container, such venting is no longer desirable because as the compartment bag 26 collapses the plastic outer shell or container also collapses. This serves as an indicator that the contents have been used and thus alerts the customer not to buy the used item. The invention also admits of filling the container with an inert gas such as nitrogen or any other gas which will not in permeating through the bag affect the product. If the plastic used such as Mylar or Saran has low permeability properties, the inert gas will remain in the container in effective concentrations for a long period of time. If the product will deteriorate in a short time a plastic of higher permeability can be used and air can be introduced into the container. Such air will gradually affect the product, but not to an extent such that it would not be useable within the dated time span (i.e.) whipped cream products. The transfer of fresh air is inhibited sufficiently to prevent unacceptable deterioration within the limit of time for product sale. The collapse of the container is such that it will indicate the integrity of the package, but the volume of the gas space in the container is proportionately several times greater than the volume of the product that even upon complete evacuation of the product, the bottle would not be too mishappen that it would collapse. It would, however, evidence that it was not full.

It will be understood that in the comestible products air would fill the chamber of the body shell 11.

We claim:

1. An aerosol container comprising a collapsible outer shell, a flexible product containing bag therein, means for dispensing the product operatively connected to the bag, means for exhausting the product from the bag through said dispensing means, said shell defining a gas filled chamber encompassing said product bag, means hermetically sealing said container with said bag therein whereby upon said product being withdrawn from said bag subatmospheric pressure develops in said chamber causing said shell to collapse after each discharge whereby serving as indicating means of prior product use.

2. An aerosol container according to claim 1, wherein said shell if formed of a gas permeable plastic.

3. The invention according to claim 2 wherein said plastic is polyethylene.

4. The invention according to claim 1, wherein said product exhausting means for aspirating the product from the bag.

5. The invention according to claim 4 wherein said bag is formed of plastic material having high barrier properties.

6. The invention according to claim 5 wherein said material is Saran.

7. The invention according to claim 2 wherein said plastic is self recoverable to its original shape as the air is drawn into the shell, said plastic serving as means for metering a predetermined amount of air into the container equal in volume to that of the displaced product.

8. The invention according to claim 1 wherein the gas in the chamber is inert to the product.

9. The invention according to claim 8 wherein said volumetric space of the chamber containing gas is greater than the volume of the product.

10. The invention according to claim 1 wherein said means for exhausting the product comprises a cartridge of high pressure gas operatively connected to said dispensing means for aspirating the product from said bag.

* * * * *